US012320344B2

(12) United States Patent
Zhong et al.

(10) Patent No.: US 12,320,344 B2
(45) Date of Patent: Jun. 3, 2025

(54) FRACTURING APPARATUS AND CONTROL METHOD THEREOF, FRACTURING SYSTEM

(71) Applicant: YANTAI JEREH PETROLEUM EQUIPMENT & TECHNOLOGIES CO., LTD., Shandong (CN)

(72) Inventors: Jifeng Zhong, Shandong (CN); Liang Lv, Shandong (CN); Xincheng Li, Shandong (CN); Yipeng Wu, Shandong (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 328 days.

(21) Appl. No.: 17/493,573

(22) Filed: Oct. 4, 2021

(65) Prior Publication Data

US 2022/0333471 A1 Oct. 20, 2022

(30) Foreign Application Priority Data

Apr. 20, 2021 (CN) ..... 202110426356.1

(51) Int. Cl.
*F04B 39/00* (2006.01)
*E21B 43/26* (2006.01)
(Continued)

(52) U.S. Cl.
CPC ..... *F04B 39/0055* (2013.01); *E21B 43/2607* (2020.05); *F04B 39/0027* (2013.01);
(Continued)

(58) Field of Classification Search
CPC ..... F04B 39/0027; F04B 39/0055; F04B 39/0284; F04B 39/066; F04B 53/08;
(Continued)

(56) References Cited

U.S. PATENT DOCUMENTS 3,794,377 A * 2/1974 Wachsmuth ..... F04B 39/0033 454/906
3,815,965 A * 6/1974 Ostwald ..... F04B 39/0033 181/204

(Continued)

FOREIGN PATENT DOCUMENTS

CN 201461291 U 5/2010
CN 201953368 U 8/2011

(Continued)

OTHER PUBLICATIONS

Non-Final Office Action for U.S. Appl. No. 17/884,358 mailed on Dec. 8, 2022.

(Continued)

*Primary Examiner* — Christopher S Bobish
(74) *Attorney, Agent, or Firm* — Sheppard Mullin Richter & Hampton LLP

(57) ABSTRACT

A fracturing apparatus, a control method of the fracturing apparatus and a fracturing system. The fracturing apparatus includes a plunger pump, a prime mover, a clutch and a clutch hydraulic system. The prime mover includes a power output shaft, and the clutch includes a first connection portion, a second connection portion and a clutch portion between the first connection portion and the second connection portion. The power end of the plunger pump includes a power input shaft, the first connection portion is connected with the power input shaft, the second connection portion is connected with the power output shaft of the prime mover, and the clutch hydraulic system is configured to provide hydraulic oil to the clutch. The fracturing apparatus further includes a first pressure sensor arranged in the clutch hydraulic system and configured to detect the hydraulic pressure of the clutch hydraulic system.

18 Claims, 3 Drawing Sheets

(51) Int. Cl.
*F04B 39/02* (2006.01)
*F04B 39/06* (2006.01)
*F04B 53/08* (2006.01)

(52) U.S. Cl.
CPC ..... *F04B 39/0284* (2013.01); *F04B 39/066* (2013.01); *F04B 53/08* (2013.01); *F04B 2201/0802* (2013.01); *F04B 2201/1201* (2013.01); *F04B 2203/0206* (2013.01); *F04B 2203/0209* (2013.01)

(58) Field of Classification Search
CPC ..... F04B 2201/1201; F04B 2201/0802; F04B 2203/0206; F04B 2203/0209; E21B 43/2607
See application file for complete search history.

(56) References Cited

U.S. PATENT DOCUMENTS 4,201,523 A * 5/1980 Olofsson ..... F04C 13/008 417/372
4,793,775 A * 12/1988 Peruzzi ..... F04B 39/16 417/313
5,282,722 A 2/1994 Beatty
5,846,056 A * 12/1998 Dhindsa ..... F04B 49/065 73/152.52
6,134,878 A * 10/2000 Amako ..... F02C 7/045 60/39.83
7,036,310 B2 5/2006 Aoki et al.
8,459,958 B2 * 6/2013 Renner ..... B66C 23/42 417/18
8,731,793 B2 * 5/2014 Barbir ..... F16D 48/06 477/76
8,788,161 B2 * 7/2014 Hofig ..... B60W 10/11 701/67
10,240,643 B2 3/2019 Clapp et al.
10,648,311 B2 5/2020 Oehring et al.
10,865,624 B1 12/2020 Cui et al.
10,914,155 B2 2/2021 Oehring et al.
10,989,180 B2 4/2021 Yeung et al.
11,047,379 B1 6/2021 Li et al.
11,109,508 B1 * 8/2021 Yeung ..... E21B 43/26
11,125,066 B1 * 9/2021 Yeung ..... F04B 49/08
11,162,484 B2 * 11/2021 Peotter ..... F04B 35/002
11,208,878 B2 12/2021 Oehring et al.
11,220,895 B1 * 1/2022 Yeung ..... E21B 43/2607
11,236,739 B2 2/2022 Yeung et al.
11,378,008 B2 * 7/2022 Yeung ..... F01D 15/08
11,391,136 B2 * 7/2022 Coli ..... F04B 1/16
11,434,737 B2 9/2022 Oehring et al.
11,459,863 B2 10/2022 Robinson et al.
11,530,602 B2 12/2022 Yeung et al.
11,578,580 B2 2/2023 Oehring et al.
11,629,584 B2 4/2023 Yeung et al.
11,859,482 B2 1/2024 Yeung et al.
12,065,968 B2 8/2024 Yeung et al.
12,084,952 B2 9/2024 Robinson et al.
12,116,875 B2 10/2024 Oehring et al.
2003/0064858 A1 * 4/2003 Saeki ..... F16D 48/06 903/902
2005/0093496 A1 * 5/2005 Tokunou ..... B60W 10/02 903/946
2010/0135840 A1 * 6/2010 Fujimoto ..... F04B 39/0033 418/201.1
2011/0061411 A1 3/2011 Kim et al.
2013/0255153 A1 10/2013 Sasaki et al.
2014/0219824 A1 * 8/2014 Burnette ..... F04B 9/04 417/234
2016/0041066 A1 * 2/2016 Patenaude ..... G01M 13/022 702/130
2016/0121871 A1 5/2016 Lee
2017/0285062 A1 * 10/2017 Kim ..... B60K 6/44
2017/0292789 A1 10/2017 Hjorth et al.
2018/0328157 A1 * 11/2018 Bishop ..... F04B 17/06
2018/0335096 A1 11/2018 Kim et al.
2019/0100989 A1 * 4/2019 Stewart ..... E21B 43/2607
2019/0128265 A1 * 5/2019 Washio ..... F04B 39/121
2019/0169971 A1 6/2019 Oehring et al.
2019/0195292 A1 * 6/2019 Pan ..... F16D 13/02
2020/0040878 A1 * 2/2020 Morris ..... F04B 49/02
2020/0049136 A1 * 2/2020 Stephenson ..... F04D 13/04
2020/0109616 A1 4/2020 Oehring et al.
2020/0109617 A1 4/2020 Oehring et al.
2020/0325760 A1 * 10/2020 Markham ..... E21B 43/26
2021/0040830 A1 * 2/2021 Mu ..... F04B 23/04
2021/0040836 A1 2/2021 Baskin
2021/0079902 A1 3/2021 Yeung et al.
2021/0095552 A1 4/2021 Oehring et al.
2021/0095648 A1 * 4/2021 Buckley ..... F04B 9/02
2021/0102451 A1 4/2021 Robinson et al.
2021/0102530 A1 * 4/2021 Pruitt ..... F04B 47/02
2021/0199161 A1 * 7/2021 Eto ..... F16D 25/0635
2021/0207588 A1 7/2021 Yeung et al.
2021/0310341 A1 10/2021 Sherman et al.
2021/0355802 A1 11/2021 Yeung et al.
2022/0018232 A1 1/2022 Oehring et al.
2022/0112889 A1 4/2022 Yeung et al.
2022/0112892 A1 4/2022 Cui et al.
2022/0213777 A1 7/2022 Cui et al.
2022/0298906 A1 9/2022 Zhong et al.
2022/0333471 A1 10/2022 Zhong et al.
2022/0364448 A1 11/2022 Oehring et al.
2023/0055844 A1 2/2023 Yeung et al.
2023/0146951 A1 5/2023 Robinson et al.
2023/0203927 A1 6/2023 Yeung et al.
2023/0272699 A1 8/2023 Oehring et al.
2023/0296050 A1 9/2023 Yeung et al.
2024/0084680 A1 3/2024 Robinson et al.
2024/0093583 A1 3/2024 Yeung et al.
2024/0295191 A1 9/2024 Yeung et al.
2024/0392666 A1 11/2024 Robinson et al.

FOREIGN PATENT DOCUMENTS

CN 202544830 U 11/2012
CN 202645914 U 1/2013
CN 205479153 U 8/2016
CN 106143468 A 11/2016
CN 107237617 A 10/2017
CN 107816341 A 3/2018
CN 108443099 A 8/2018
CN 208281489 U 12/2018
CN 109296733 A 2/2019
CN 109578459 A 4/2019
CN 209041375 U 6/2019
CN 110374164 A 10/2019
CN 209469732 U 10/2019
CN 111043023 A 4/2020
CN 111156266 A 5/2020
CN 109578459 B 7/2020
CN 111502974 A 8/2020
CN 112983381 A 6/2021
CN 214741267 U 11/2021
RU 163399 U1 7/2016
RU 178973 U1 4/2018
WO 2018/025891 A1 2/2018

OTHER PUBLICATIONS

Final Office Action for U.S. Appl. No. 17/733,922 mailed on Dec. 28, 2022.
Notice of Allowance for U.S. Appl. No. 17/884,358 mailed on Feb. 8, 2023.
Written Opinion and International Search Report for PCT Application No. PCT/CN2021/139240 mailed on Mar. 16, 2022.
Non-Final Office Action for U.S. Appl. No. 17/733,922 mailed on Sep. 21, 2022.
First Search for Chinese Application No. 202110426356.1 mailed on Dec. 3, 2023.

(56) References Cited

OTHER PUBLICATIONS

Deng, "Safety Evaluation of BY610Z Hydraulic Transmission Used in Underground Fracturing Pump Unit of Coal Mine," Jun. 15, 2019, English abstract provided.
Non-Final Office Action for U.S. Appl. No. 18/360,678 mailed on Feb. 28, 2024.
Office Action for Russian Application No. 2022132812 mailed on May 22, 2023.
Office Action for Russian Application No. 2022132812 mailed on Dec. 19, 2023.
Non-Final Office Action for U.S. Appl. No. 17/493,573 mailed on Jul. 5, 2024.
Notice of Allowance for U.S. Appl. No. 18/311,042 mailed on Sep. 27, 2024.
Notice of Allowance for U.S. Appl. No. 18/360,678 mailed on Aug. 20, 2024.
Notice of Allowance for U.S. Appl. No. 18/348,761 mailed on Oct. 21, 2024.
Third Office Action for Chinese Application No. 202110426356.1 mailed on Oct. 13, 2024. English machine translation provided.
Search Report for Chinese Application No. 202110426356.1 mailed on Oct. 14, 2024. English machine translation provided.
Deng et al., "Safety evaluation of BY610Z hydraulic transmission for coal mine underground fracturing pump unit", Jun. 15, 2019. English Machine translation of the abstract provided.
Fourth Office Action for Chinese Application No. 202110426356.1 mailed on Jan. 11, 2025.
Supplemental Search for Chinese Application No. 202110426356.1 mailed Jan. 11, 2025.
Notice of Allowance for U.S. Appl. No. 18/643,904 mailed on Feb. 4, 2025.
Rejection Decision for Chinese Application No. 202110426356.1 mailed on Mar. 26, 2025.

* cited by examiner

300

300

FRACTURING APPARATUS AND CONTROL METHOD THEREOF, FRACTURING SYSTEM

The present application claims the priority of the Chinese patent application No. 202110426356.1 filed on Apr. 20, 2021, for all purposes, the disclosure of which is incorporated herein by reference in its entirety as part of the present application.

TECHNICAL FIELD

Embodiments of the present disclosure relate to a fracturing apparatus, a control method of the fracturing apparatus, and a fracturing system.

BACKGROUND

In the field of oil and gas exploitation, fracturing technology is a method to make oil and gas reservoirs crack by using high-pressure fracturing liquid. Fracturing technology can improve the flowing environment of oil and gas underground by causing cracks in oil and gas reservoirs, which can increase the output of oil wells. Therefore, it is widely used in conventional and unconventional oil and gas exploitation, offshore and onshore oil and gas resources development.

Plunger pump is a device that uses the reciprocating motion of a plunger in a cylinder to pressurize liquid. Plunger pump has the advantages of high rated pressure, compact structure and high efficiency, so it is used in fracturing technology.

SUMMARY

Embodiments of the present disclosure provide a fracturing apparatus, a control method of the fracturing apparatus, and a fracturing system. Upon the first pressure sensor detecting that the pressure of the hydraulic oil provided by the clutch hydraulic system to the clutch is smaller than a preset pressure value, the fracturing apparatus can control the clutch to disengage, so that the clutch slip phenomenon caused by relatively low liquid pressure can be avoided, deterioration of the fault can be further avoided, and pertinent overhaul and maintenance can be carried out.

At least one embodiment of the present disclosure provides a fracturing apparatus, which includes: a plunger pump, including a power end and a hydraulic end; a prime mover, including a power output shaft; a clutch, including a first connection portion, a second connection portion and a clutch portion between the first connection portion and the second connection portion; and a clutch hydraulic system, configured to provide hydraulic oil to the clutch, the power end of the plunger pump includes a power input shaft, the first connection portion is connected with the power input shaft, the second connection portion is connected with the power output shaft of the prime mover, the fracturing apparatus further includes a first pressure sensor configured to detect a hydraulic pressure of the clutch hydraulic system.

For example, in the fracturing apparatus provided by an embodiment of the present disclosure, the fracturing apparatus further includes: a second pressure sensor, the hydraulic end of the plunger pump includes a liquid output end, and the second pressure sensor is configured to detect a pressure of liquid output by the liquid output end.

For example, the fracturing apparatus provided by an embodiment of the present disclosure further includes: a discharge manifold, connected with the liquid output end, the second pressure sensor is arranged on the liquid output end or the discharge manifold.

For example, in the fracturing apparatus provided by an embodiment of the present disclosure, the fracturing apparatus includes two plunger pumps, one prime mover, two clutches, two clutch hydraulic systems and two first pressure sensors, the two first pressure sensors are arranged in one-to-one correspondence with the two clutch hydraulic systems, and the first pressure sensor is configured to detect a hydraulic pressure of a corresponding one of the two clutch hydraulic systems.

For example, the fracturing apparatus provided by an embodiment of the present disclosure further including: a first temperature sensor, configured to detect a temperature of the clutch.

For example, the fracturing apparatus provided by an embodiment of the present disclosure further including: a second temperature sensor, configured to detect a temperature of hydraulic oil in the clutch hydraulic system.

For example, the fracturing apparatus provided by an embodiment of the present disclosure further including: a first vibration sensor, configured to detect vibration of the plunger pump, the fracturing apparatus further includes a plunger pump base, the plunger pump is arranged on the plunger pump base, and the first vibration sensor is arranged on the plunger pump or the plunger pump base.

For example, the fracturing apparatus provided by an embodiment of the present disclosure further including: a second vibration sensor, configured to detect vibration of the prime mover, the fracturing apparatus further includes a prime mover base, the prime mover is arranged on the prime mover base, and the second vibration sensor is arranged on the prime mover or the prime mover base.

For example, the fracturing apparatus provided by an embodiment of the present disclosure further including: a first rotation speed sensor, configured to detect an actual rotation speed of the power input shaft of the plunger pump; and a second rotation speed sensor, configured to detect an actual rotation speed of the power output shaft of the prime mover.

For example, the fracturing apparatus provided by an embodiment of the present disclosure further including: a planetary gear box, including an input gear shaft, the first connection portion of the clutch is directly connected with the input gear shaft, and the power input shaft is directly connected with the planetary gear box.

For example, in the fracturing apparatus provided by an embodiment of the present disclosure, the prime mover includes one of a diesel engine, an electric motor and a turbine engine.

At least one embodiment of the present disclosure further provides a control method of a fracturing apparatus, the fracturing apparatus including the abovementioned fracturing apparatus, the control method including: detecting the hydraulic pressure of the clutch hydraulic system; and controlling the clutch to disengage if the hydraulic pressure of the clutch hydraulic system as detected is smaller than a first preset pressure value.

For example, the control method of the fracturing apparatus provided by an embodiment of the present disclosure further including: detecting a pressure of liquid output by the plunger pump; and controlling the clutch to disengage if the pressure of the liquid output by the plunger pump as detected is higher than a second preset pressure value.

For example, the control method of the fracturing apparatus provided by an embodiment of the present disclosure further including: detecting a temperature of the clutch; and controlling the clutch to disengage if the temperature of the clutch as detected is higher than a first preset temperature value.

For example, the control method of the fracturing apparatus provided by an embodiment of the present disclosure further including: detecting a temperature of hydraulic oil in the clutch hydraulic system; and controlling the clutch to disengage if the temperature of the hydraulic oil in the clutch hydraulic system as detected is higher than a second preset temperature value.

For example, the control method of the fracturing apparatus provided by an embodiment of the present disclosure further including: detecting a vibration of the plunger pump; and controlling the clutch to disengage if the vibration of the plunger pump as detected is higher than a first preset vibration value.

For example, the control method of the fracturing apparatus provided by an embodiment of the present disclosure further including: detecting a vibration of the prime mover; and controlling the clutch to disengage if the vibration of the prime mover as detected is higher than a second preset vibration value.

For example, the control method of the fracturing apparatus provided by an embodiment of the present disclosure further including: detecting a first actual rotation speed of the power input shaft of the plunger pump; detecting a second actual rotation speed of the power output shaft of the prime mover; and calculating a ratio of the first actual rotation speed and the second actual rotation speed, and controlling the clutch to disengage if the ratio is smaller than a first preset ratio or greater than a second preset ratio.

At least one embodiment of the present disclosure further provides a fracturing system, which includes any one of the abovementioned fracturing apparatus, a control system configured to control the clutch in the fracturing apparatus; and a remote control unit communicated with the control system.

BRIEF DESCRIPTION OF THE DRAWINGS

In order to more clearly illustrate the technical solutions of the embodiments of the disclosure, the drawings of the embodiments will be briefly described in the following; it is obvious that the described drawings below are only related to some embodiments of the disclosure and thus are not limitative to the disclosure.

DETAILED DESCRIPTION

In order to make objectives, technical details and advantages of the embodiments of the present disclosure more clearly, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "include," "including," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

With the continuous development of fracturing apparatus, the plunger pump in fracturing apparatus is gradually changed from being driven by a diesel engine to being driven by an electric motor or a turbine engine to meet higher environmental protection requirements. In this case, such fracturing apparatus also has the advantages of high power and low construction cost.

Figure 1:
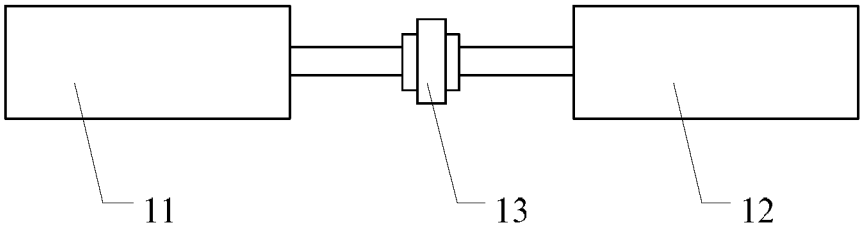
FIG. 1 is a schematic diagram of a fracturing apparatus.

FIG. 1 is a schematic diagram of a fracturing apparatus. As illustrated by FIG. 1, the fracturing apparatus 10 includes a plunger pump 11 and an electric motor 12. A power output shaft of the electric motor 12 is connected with a power input shaft of the plunger pump 11 through a clutch 13. Because of frequent engagement or disengagement, the clutch 13 has a relatively high damage frequency. On the other hand, in fracturing operation, the plunger pump needs to operate stably and continuously, so the requirements on the stability of clutch is very high. Therefore, if there is a problem in the clutch of the fracturing apparatus during operation, and the problem cannot be judged and treated in time, it will cause great economic losses to the fracturing operation. It should be noted that the fracturing apparatus illustrated in FIG. 1 can adopt a mode of one engine and one pump (that is, one electric motor drives one plunger pump) or a mode of one engine and two pumps (that is, one electric motor drives two plunger pumps).

On the other hand, before or at the end of fracturing apparatus operation, maintenance personnel are required to carry out maintenance evaluation, and maintenance personnel shall check and judge faults according to experience. However, as mentioned above, fracturing apparatus has high requirements on stability, and belongs to construction operation equipment with high power (the rated maximum output power of a single plunger pump is usually higher than 2000 hp) and high pressure (the rated pressure of the plunger pump is usually not smaller than 10000 psi) (the maximum pressure can usually exceed 40 MPa during construction), and maintenance personnel cannot check and repair nearby during operation. Therefore, once the fracturing apparatus has problems during the operation, it will bring risks to the fracturing operation. In addition, once the fracturing apparatus has appeared potential failure, which cannot be detected by maintenance personnel, it will bring great potential safety hazards to fracturing operation.

In this regard, embodiments of the present disclosure provide a fracturing apparatus, a control method of the fracturing apparatus, and a fracturing system. The fracturing apparatus includes a plunger pump, a prime mover, a clutch and a clutch hydraulic system. The plunger pump includes a power end and a liquid end, the prime mover includes a power output shaft, and the clutch includes a first connection portion, a second connection portion and a clutch portion between the first connection portion and the second connection portion. The power end of the plunger pump includes a power input shaft, the first connection portion is connected with the power input shaft, the second connection portion is connected with the power output shaft of the prime mover, and the clutch hydraulic system is configured to provide hydraulic oil to the clutch. The fracturing apparatus further includes a first pressure sensor arranged in the clutch hydraulic system and configured to detect the hydraulic pressure of the clutch hydraulic system. Therefore, upon the first pressure sensor detecting that the pressure of the hydraulic oil provided by the clutch hydraulic system to the clutch is smaller than a preset pressure value, the fracturing apparatus can control the clutch to disengage, so that the clutch slip phenomenon caused by lower liquid pressure can be avoided, further deterioration of the fault can be avoided, and pertinent overhaul and maintenance can be carried out.

Hereinafter, the fracturing apparatus provided by the embodiments of the present disclosure will be described in detail with reference to the accompanying drawings.

Figure 2A:
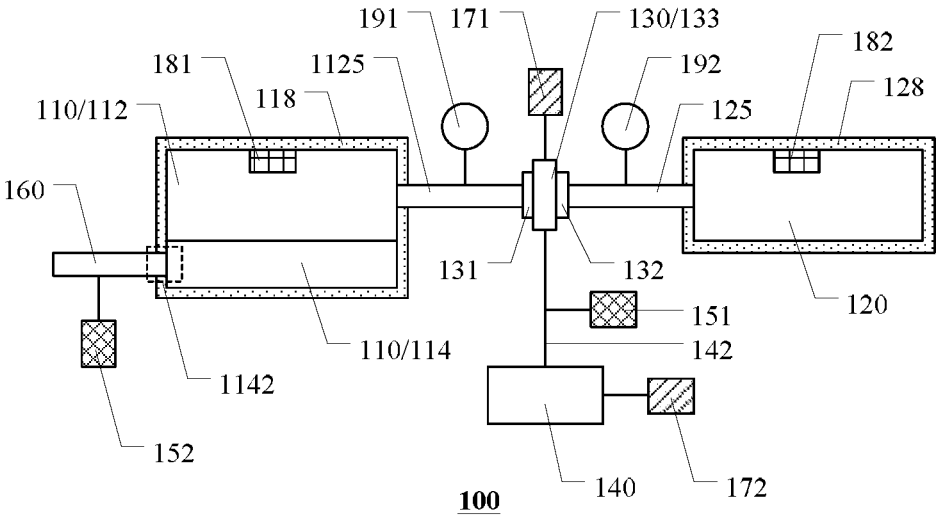
FIG. 2A is a schematic diagram of a fracturing apparatus according to an embodiment of the present disclosure.
Figure 2B:
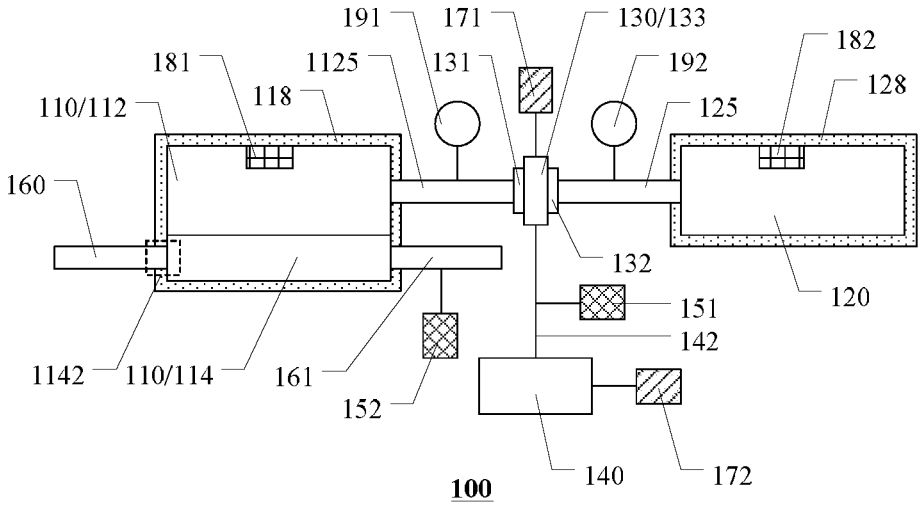
FIG. 2B is a schematic diagram of another fracturing apparatus according to an embodiment of the present disclosure.

An embodiment of the present disclosure provides a fracturing apparatus. FIG. 2A is a schematic diagram of a fracturing apparatus according to an embodiment of the present disclosure; FIG. 2B is a schematic diagram of another fracturing apparatus according to an embodiment of the present disclosure. As illustrated by FIGS. 2A and 2B, the fracturing apparatus 100 includes a plunger pump 110, a prime mover 120, a clutch 130 and a clutch hydraulic system 140. The plunger pump 110 includes a power end 112 and a liquid end 114, the prime mover 120 includes a power output shaft 125, and the clutch 130 includes a first connection portion 131, a second connection portion 132 and a clutch portion 133 between the first connection portion 131 and the second connection portion 132. The power end 112 of the plunger pump 110 includes a power input shaft 1125, the first connection portion 131 is connected with the power input shaft 1125, the second connection portion 132 is connected with the power output shaft 125 of the prime mover 120, and the clutch hydraulic system 140 is configured to provide hydraulic oil to the clutch 130. The fracturing apparatus 100 further includes a first pressure sensor 151 configured to detect the hydraulic pressure of the clutch hydraulic system 140, that is, the pressure value of the hydraulic oil provided by the clutch hydraulic system 140 to the clutch 130. It should be noted that various "pressures" or "pressure values" in the present disclosure are pressure values obtained by pressure gauges or pressure sensors. In a fracturing apparatus, the clutch hydraulic system is configured to provide hydraulic oil to the clutch. If the pressure of hydraulic oil does not meet the requirements because of oil leakage and other reasons, the clutch will have a slip phenomenon, in addition, if it is not treated in time, more serious faults may occur, which will bring greater potential safety hazards and greater economic losses to fracturing operations. However, the fracturing apparatus provided by the embodiments of the present disclosure detects the hydraulic value of the hydraulic oil provided to the clutch by the clutch hydraulic system through the first pressure sensor, upon the first pressure sensor detecting that the hydraulic value of the hydraulic oil provided to the clutch by the clutch hydraulic system is smaller than the preset pressure value, the fracturing apparatus can control the clutch to disengage, so that the clutch slip phenomenon caused by lower hydraulic pressure can be avoided, thus further deterioration of the fault can be avoided, and pertinent overhaul and maintenance can be carried out. In addition, the hydraulic pressure of the hydraulic oil provided to the clutch by the clutch hydraulic system detected by the first pressure sensor can be displayed remotely, so that remote operation can be realized and the operation difficulty and cost can be reduced.

In some examples, the prime mover includes one of a diesel engine, an electric motor, and a turbine engine. Of course, the embodiments of the present disclosure include but are not limited thereto, and the prime mover can also be other machines that provide power.

Figure 3:
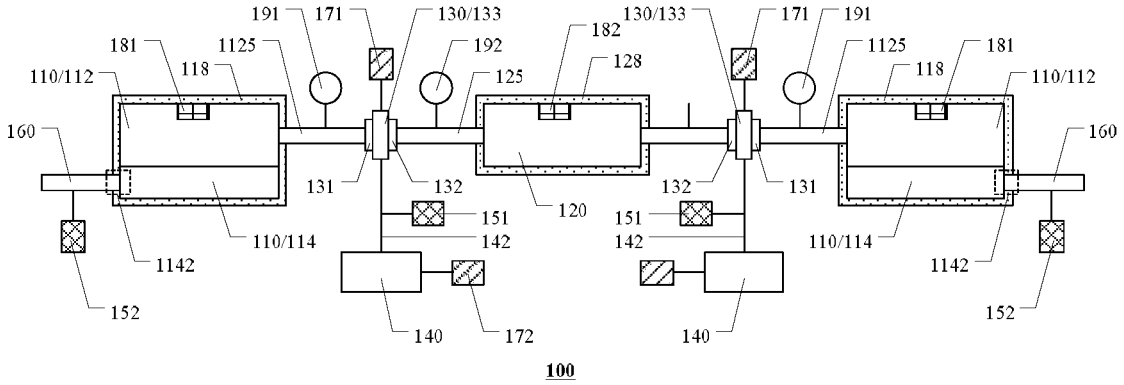
FIG. 3 is a schematic diagram of another fracturing apparatus according to an embodiment of the present disclosure.

FIG. 3 is a schematic diagram of another fracturing apparatus according to an embodiment of the present disclosure. As illustrated by FIG. 3, the fracturing apparatus 100 includes two plunger pumps 110 and one prime mover 120. One prime mover 120 can drive two plunger pumps 110 at the same time. In this case, the fracturing apparatus 100 can include two clutches 130, two clutch hydraulic systems 140, and two first pressure sensors 151. The two first pressure sensors 151 are arranged in one-to-one correspondence with the two clutch hydraulic systems 140, and each first pressure sensor 151 is configured to detect the hydraulic pressure of the corresponding clutch hydraulic system 140. Therefore, upon the first pressure sensor detecting that the hydraulic value of the hydraulic oil provided by any one of the two clutch hydraulic systems is smaller than the preset pressure value, the corresponding clutch can be controlled to disengage, thereby ensuring the normal operation of the other plunger pump.

In some examples, as illustrated by FIG. 2A, the clutch hydraulic system 140 includes an oil supply pipeline 142, the oil supply pipeline 142 is connected with the clutch 130 so as to provide hydraulic oil for the clutch 130. In this case, the first pressure sensor 151 can be arranged on the oil supply pipeline 142, so that the hydraulic pressure of the clutch hydraulic system 140 can be better detected. Of course, the embodiments of the present disclosure include but are not limited thereto, and the first pressure sensor can also be arranged at other suitable positions as long as it can detect the hydraulic pressure of the clutch hydraulic system.

In some examples, because the clutch rotates in the working state, the oil supply pipeline can be connected with the clutch through a rotary joint. Of course, the embodiments of the present disclosure include but are not limited thereto, and the oil supply pipeline can also be connected with the clutch in other ways. In addition, the type of rotary joint can be selected according to the actual situation. In some examples, as illustrated by FIG. 2A, the fracturing apparatus 100 further includes a second pressure sensor 152. The hydraulic end 114 of the plunger pump 110 includes a liquid output end 1142, and the second pressure sensor 152 is configured to detect the pressure of the liquid output from the liquid output end 1142. Upon the fracturing apparatus performing fracturing operations, it is needed for the fracturing apparatus to provide fracturing liquid meeting the preset pressure value. If the pressure of the liquid output from the liquid output end 1142 of the plunger pump 110 is greater than the safe pressure value (for example, 90 MPa), it is needed to protect the transmission and high-pressure components of the apparatus. In this case, the fracturing apparatus can quickly disengage the clutch and protect the transmission and high-pressure components of the apparatus, thus playing a safe role.

For example, upon the pressure of the liquid output by the liquid output end of the plunger pump being greater than the safe pressure value, the fracturing apparatus can control the clutch hydraulic system through the control system to make the clutch quickly disengage. Of course, the embodiments of the present disclosure include but are not limited thereto, the fracturing apparatus can also play a safe role by stopping the rotation of the electric motor, stopping the power supply of the electric motor, or stopping the output of the electric motor frequency converter through the control system upon the pressure of the liquid output by the liquid output end of the plunger pump being greater than the safe pressure value.

In some examples, as illustrated by FIG. 3, the fracturing apparatus 100 includes two plunger pumps 110 and a prime mover 120. One prime mover 120 can drive two plunger pumps 110 at the same time. In this case, the fracturing apparatus 100 can include two clutches 130, two clutch hydraulic systems 140, and two second pressure sensors 152. The two second pressure sensors 152 are arranged in one-to-one correspondence with the two liquid output ends 1142 of the two plunger pumps 110, and each second pressure sensor 151 is configured to detect the hydraulic pressure of the corresponding liquid output end 1142. Therefore, upon the second pressure sensors detects that the hydraulic pressure provided by any one of the two liquid output ends being greater than the safe pressure value, the clutch can be quickly disengaged to protect the transmission and high-pressure components of the apparatus, thus playing a safe role.

In some examples, as illustrated by FIG. 2A, the fracturing apparatus 100 further includes a discharge manifold 160, the discharge manifold 160 is connected with the liquid output end 1142. In this case, the second pressure sensor 152 can be arranged on the liquid output end 1142 or the discharge manifold 160, so as to better detect the pressure of the liquid output by the liquid output end 1142. Of course, the embodiments of the present disclosure include but are not limited thereto, and the second pressure sensor can also be arranged at other suitable positions as long as it can detect the pressure of the liquid output by the liquid output end; for example, the second pressure sensor can be arranged on a pressure relief manifold.

For example, as illustrated by FIG. 2A, the discharge manifold 160 of the fracturing apparatus 100 is only arranged on a side of the plunger pump 110 away from the clutch 130, in addition, as illustrated by FIG. 2B, the fracturing apparatus 100 also has an auxiliary manifold 161 on a side of the plunger pump 110 away from the discharge manifold 160. In this case, the second pressure sensor 152 can also be arranged on the auxiliary manifold 161, and the auxiliary manifold 161 can be configured to discharge high-pressure liquid or relieve pressure.

In some examples, as illustrated by FIGS. 2A and 2B, the fracturing apparatus 100 further includes a first temperature sensor 171 configured to detect the temperature of the clutch 130. Therefore, the fracturing apparatus detects the temperature of the clutch through the first temperature sensor, and upon the first temperature sensor detects that the temperature of the clutch being higher than a preset temperature value, the clutch can be controlled to disengage, so that various faults caused by high clutch temperature can be avoided, further deterioration of faults can be avoided, and pertinent overhaul and maintenance can be carried out. In addition, the temperature of the clutch detected by the first temperature sensor can be displayed remotely, so that remote operation can be realized, and the operation difficulty and cost can be reduced. It should be noted that the first temperature sensor is configured to detect the temperature of the clutch, but the first temperature sensor is not needed to be installed on the clutch, because the clutch will rotate, and the stability of the first temperature sensor using wiring or wireless connection is easy to have problems, so the first temperature sensor can use non-contact temperature measurement methods such as infrared temperature measurement.

In some examples, as illustrated by FIGS. 2A and 2B, the fracturing apparatus 100 further includes a second temperature sensor 172, the second temperature sensor 172 is configured to detect the temperature of the clutch hydraulic system 140. Therefore, the fracturing apparatus detects the temperature of hydraulic oil in the clutch hydraulic system through the second temperature sensor, and upon the second temperature sensor detecting that the temperature of hydraulic oil in the clutch hydraulic system is higher than the preset temperature value, it can control the clutch to disengage, thus avoiding various faults caused by high clutch temperature, thus avoiding further deterioration of faults, and carrying out pertinent overhaul and maintenance.

In some examples, as illustrated by FIG. 3, the fracturing apparatus 100 includes two plunger pumps 110 and one prime mover 120. One prime mover 120 can drive two plunger pumps 110 at the same time. In this case, the fracturing apparatus 100 can include two clutches 130, two clutch hydraulic systems 140, two first temperature sensors 171 and two second temperature sensors 172. The two first temperature sensors 171 are arranged in one-to-one correspondence with the two clutches 130, and each first temperature sensor 171 is configured to detect the temperature of the corresponding clutch 130. The two second temperature sensors 172 are arranged in one-to-one correspondence with the two clutch hydraulic systems 140, and each second temperature sensor 172 is configured to detect the temperature of the corresponding clutch hydraulic system 140. Therefore, upon the first temperature sensors detecting that the temperature of any one of the two clutches is abnormal or the second temperature sensors detecting that the temperature of any one of the two clutch hydraulic systems is abnormal, the corresponding clutch can be controlled to disengage, thus ensuring the normal operation of the other plunger pump.

In some examples, as illustrated by FIGS. 2A and 2B, the fracturing apparatus 100 further includes a first vibration sensor 181, the first vibration sensor 181 is configured to detect the vibration of the plunger pump 110. The fracturing apparatus 100 further includes a plunger pump base 118, the plunger pump 110 is arranged on the plunger pump base 118, and the first vibration sensor 181 is located on the plunger pump 110 or the plunger pump base 118. During the operation process of the fracturing apparatus, upon the clutch failing, the transmission between the clutch and the plunger pump will be abnormal, resulting in higher vibration value of the plunger pump. The fracturing apparatus provided in this example detects the vibration of the plunger pump through the first vibration sensor, upon the vibration of the plunger pump being greater than a preset vibration value, the clutch can be controlled to disengage, and the input power of the plunger pump can be completely cut off, so that the further deterioration of the fault can be avoided, and the pertinent overhaul and maintenance can be carried out. In addition, because the first vibration sensor is located on the plunger pump (such as the housing of the plunger pump) or the plunger pump base, the first vibration sensor is rigidly connected with the plunger pump in this case, and the first vibration sensor can better reflect the vibration of the plunger pump.

In some examples, as illustrated by FIG. 3, the fracturing apparatus 100 includes two plunger pumps 110 and one prime mover 120. One prime mover 120 can drive two plunger pumps 110 at the same time. In this case, the fracturing apparatus 100 can include two clutches 130, two clutch hydraulic systems 140, and two first vibration sensors 181. Therefore, upon the first vibration sensor 181 detecting that the vibration of any one of the two plunger pumps is greater than the preset vibration value, the corresponding clutch can be controlled to disengage, thereby ensuring the normal operation of the other plunger pump.

In some examples, as illustrated by FIGS. 2A and 2B, the fracturing apparatus 100 further includes a second vibration sensor 182, the second vibration sensor 182 is configured to detect the vibration of the prime mover 120. The fracturing apparatus 100 further includes a prime motor base 128, the prime mover 120 is arranged on the prime motor base 128, the second vibration sensor 182 is arranged on the prime mover 120 or the prime motor base 128. During the operation process of the fracturing apparatus, upon the clutch failing, the transmission between the clutch and the prime mover will be abnormal, resulting in high vibration value of the prime mover. The fracturing apparatus provided in this example detects the vibration of the prime mover through the first vibration sensor, and upon the vibration of the prime mover being greater than the preset vibration value, the clutch can be controlled to disengage, so that the further deterioration of the fault can be avoided, and pertinent overhaul and maintenance can be carried out. In addition, because the second vibration sensor is located on the prime mover (such as the housing of the prime mover) or the prime mover base, the second vibration sensor can better reflect the vibration of the prime mover.

In some examples, as illustrated by FIGS. 2A and 2B, the fracturing apparatus 100 further includes a first rotation speed sensor 191 and a second rotation speed sensor 192. The first rotation speed sensor 191 is configured to detect the actual rotation speed of the power input shaft 1125 of the plunger pump 110. The second rotation speed sensor 192 is configured to detect the actual rotation speed of the power output shaft 125 of the prime mover 120. Therefore, upon the actual rotation speed detected by the first rotation speed sensor 191 not matching the actual rotation speed detected by the second sensor 192, for example, the transmission ratio being not conformed, it can be judged that the clutch is abnormal. In this case, the clutch can be controlled to disengage, so that further deterioration of the fault can be avoided, and pertinent overhaul and maintenance can be carried out.

In some examples, as illustrated by FIGS. 2A and 2B, the first rotation speed sensor 191 can be arranged on the power input shaft 1125 of the plunger pump 110, so that the space that can be fixed and protected is larger. It should be noted that if the rotation speed sensor is installed on the clutch or its upper and lower regions, there is a greater risk of damage to the rotation speed sensor upon the clutch being overhauled or oil leakage occurs. Moreover, the fault jitter of clutch can easily cause the deviation of detection data. However, the fracturing apparatus provided in this example can install the first rotation speed sensor on the power input shaft of the plunger pump, which will not be affected by clutch failure or clutch overhaul.

In some examples, as illustrated by FIG. 3, the fracturing apparatus 100 includes two plunger pumps 110 and one prime mover 120. One prime mover 120 can drive two plunger pumps 110 at the same time. In this case, the fracturing apparatus 100 can include two clutches 130, two clutch hydraulic systems 140, two first rotation speed sensors 191 and one second rotation speed sensor 192. Therefore, upon the rotation speed of any one of the two plunger pumps detected by the two first rotation speed sensors 191 being not match the rotation speed of the prime mover detected by the second rotation speed sensor 192, the corresponding clutch can be controlled to disengage, thereby ensuring the normal operation of the other plunger pump.

It should be noted that both the fracturing apparatus illustrated in FIGS. 2A and 2B and the fracturing apparatus illustrated in FIG. 3 can be provided with at least three kinds of the above-mentioned first pressure sensor, second pressure sensor, first temperature sensor, first vibration sensor, second vibration sensor, first rotation speed sensor and second rotation speed sensor at the same time, so as to evaluate the state of the clutch from different aspects, thus controlling the clutch to disengage upon the clutch being abnormal, thus avoiding further deterioration of the fault, and pertinent overhaul and maintenance can be carried out.

Figure 4:
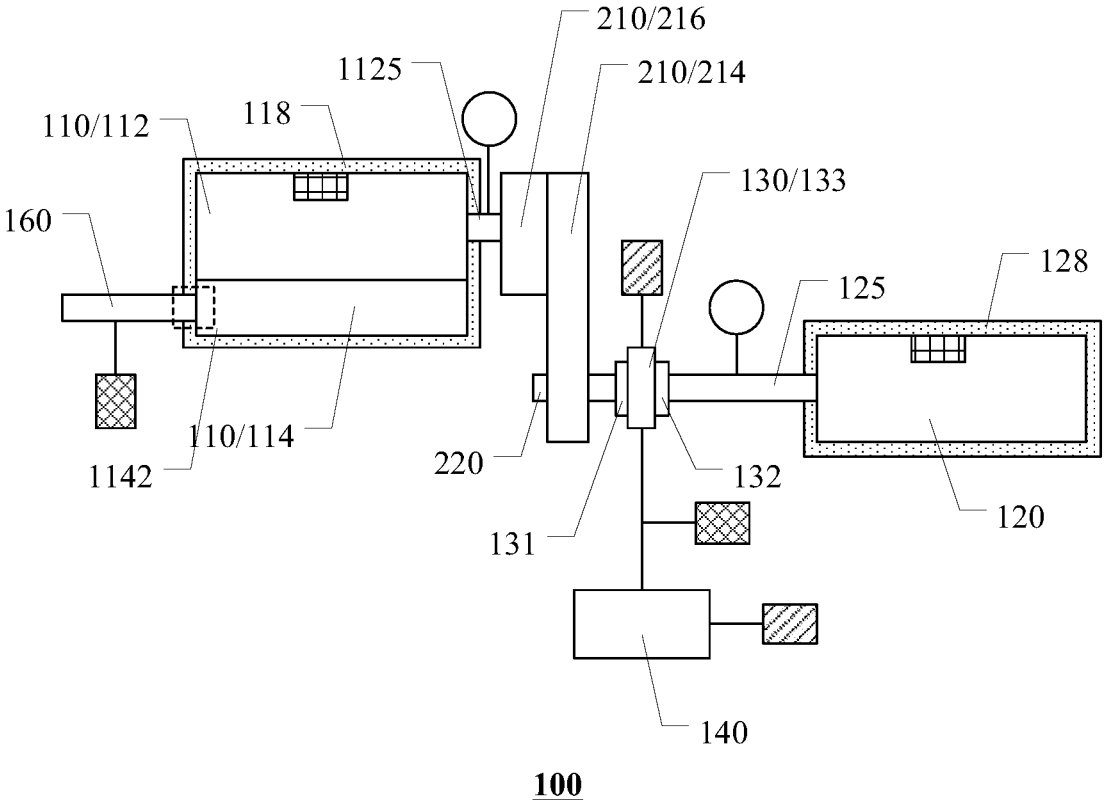
FIG. 4 is a schematic diagram of another fracturing apparatus according to an embodiment of the present disclosure.

FIG. 4 is a schematic diagram of another fracturing apparatus according to an embodiment of the present disclosure. As illustrated by FIG. 4, the fracturing apparatus 100 can further include a reduction gear box 210, the reduction gear box 210 includes an input gear shaft 212. The input gear shaft 212 is directly connected with the first connection portion 131 of the clutch 130, and the power input shaft 1125 is directly connected with the reduction gear box 210. The reduction gear box 210 can include a planetary gear box 216 and a parallel shaft gear box 214, in this case, the parallel shaft gear box 214 is connected with the input gear shaft 212, and the power input shaft 1125 is directly connected with the planetary gear box 216.

In a common fracturing apparatus, the clutch is connected with the power input shaft of the plunger pump. In the operation process of fracturing apparatus, the vibration or jitter of the plunger pump itself is obviously higher than the vibration or jitter of the prime mover because of the crankshaft structure of the power input shaft and the instantaneous pressure fluctuation of the inlet and outlet of the plunger pump. In addition, the clutch itself is heavy, and the clutch also includes a moving mechanism and a sealing structure, so connecting the clutch with the power input shaft of the plunger pump is prone to failure. In addition, the power input shaft of the plunger pump needs to be directly connected with the clutch, and the plunger pump itself is usually provided with a plunger pump reduction gear box, so the power input shaft of the plunger pump needs to pass through the plunger pump body and the plunger pump reduction gear box and be connected with the clutch, thus resulting in a large length of the power input shaft; in addition, the power input shaft needs to form a hydraulic oil hole penetrating through the power input shaft, and the long length of the power input shaft will also lead to the long length of the hydraulic oil hole need to be formed, resulting in high processing difficulty and cost.

However, the fracturing apparatus provided in this example directly connects the first connection portion of the clutch with the input gear shaft of the planetary gear box, and the planetary gear box is directly connected with the power input shaft, so there is no need to connect the clutch with the power input shaft of the plunger pump. Therefore, the fracturing apparatus can reduce the failure rate of the clutch. On the other hand, the power input shaft of the plunger pump does not need to be directly connected with the clutch, which can greatly reduce the length of the power input shaft of the plunger pump, thereby greatly reducing the processing difficulty of the power input shaft and hydraulic oil holes in the power input shaft and reducing the cost.

For example, upon the plunger pump being a five-cylinder plunger pump, the length of the power input shaft can be reduced from more than 2 meters to smaller than 0.8 meters, thus greatly reducing the processing difficulty of the power input shaft and reducing the cost.

Figure 5:
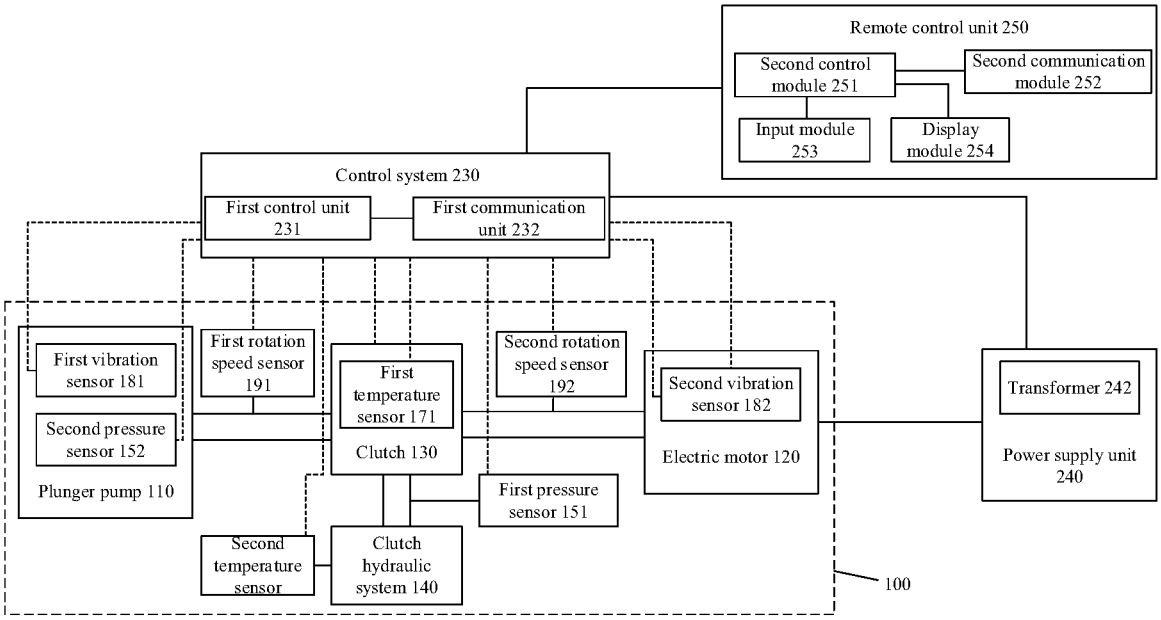
FIG. 5 is a schematic diagram of a fracturing system according to an embodiment of the present disclosure.

FIG. 5 is a schematic diagram of a fracturing system according to an embodiment of the present disclosure. The fracturing system 300 includes the fracturing apparatus 100 provided by any one of the above examples. The fracturing system 300 further includes a control system 230; the control system 230 includes a first control unit 231 and a first communication module 232. The control system 230 is electrically connected with the clutch 130; the control system 230 is communicatively connected with the first pressure sensor 151, the second pressure sensor 152, the first temperature sensor 171, the second temperature sensor 172, the first vibration sensor 181, the second vibration sensor 182, the first rotation speed sensor 191 and the second rotation speed sensor 192. The control system 230 can control the clutch 130 according to the parameters fed back by the first pressure sensor 151, the second pressure sensor 152, the first temperature sensor 171, the second temperature sensor 172, the first vibration sensor 181, the second vibration sensor 182, the first rotation speed sensor 191 and the second rotation speed sensor 192.

For example, upon the first pressure sensor detecting that the hydraulic pressure value of the hydraulic oil provided by the clutch hydraulic system to the clutch being smaller than the preset pressure value, the control system can control the clutch to disengage so as to avoid the clutch slip phenomenon caused by the lower hydraulic pressure, thus avoiding the further deterioration of the fault and carrying out pertinent overhaul and maintenance. For the control method of the control system according to the parameters fed back by other sensors, please refer to the description of the relevant sensors, which will not be repeated here.

It should be noted that the control system 230 can be connected with the above-mentioned sensors in a wired manner, or can be connected with the above-mentioned sensors in a wireless manner.

In some examples, as illustrated by FIG. 5, the fracturing system 300 further includes a remote control unit 250. The remote control unit 250 includes a second control module 251, a second communication module 252, an input module 253 and a display module 254. The remote control unit 250 can communicate with the first communication module 232 of the control system 230 through the second communication module 252. The second control module 251 is respectively connected with the input module 253 and the display module 254. Therefore, the remote control unit 250 can receive the data of the control system 230 and display it on the display module 254. The user can also send control instructions to the control system 230 through the input module 253 of the remote control unit 250.

In some examples, as illustrated by FIG. 5, the fracturing system 300 further includes a power supply unit 240, the power supply unit 240 includes a transformer 242. Upon the prime mover 120 being an electric motor, the power supply unit 240 can be connected with the prime mover 120 to supply power to the prime mover 120. In addition, the power supply unit 240 can also be connected with the control system 230 to supply power to the control system 230.

Figure 6:
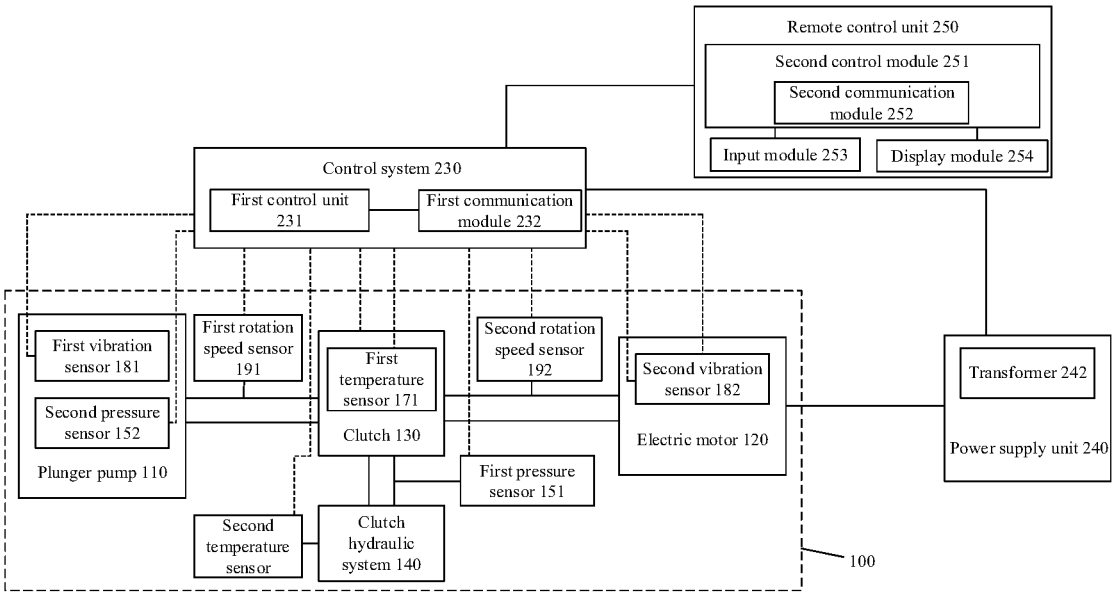
FIG. 6 is a schematic diagram of a fracturing system according to an embodiment of the present disclosure.

FIG. 6 is a schematic diagram of another fracturing system according to an embodiment of the present disclosure. As illustrated by FIG. 6, in the remote control unit 250, the second communication module 252 can be integrated in the second control module 251, thereby improving the integration of the remote control unit. Therefore, the second control module 251 can directly receive the data of the control system 230 and display it on the display module 254. The user can also send control instructions to the control system 230 through the input module 253 of the remote control unit 250.

At least one embodiment of the present disclosure further provides a control method of a fracturing apparatus. The fracturing apparatus can be the fracturing apparatus provided by any of the above examples. In this case, the control method includes: detecting the hydraulic pressure of the clutch hydraulic system; and controlling the clutch to disengage if the detected hydraulic pressure of the clutch hydraulic system is smaller than a first preset pressure value.

In the control method provided by the embodiment of the present disclosure, Upon the hydraulic pressure value of the hydraulic oil provided to the clutch by the clutch hydraulic system being smaller than the first preset pressure value, the clutch is controlled to disengage, so that the clutch slip phenomenon caused by lower hydraulic pressure can be avoided, further deterioration of faults can be avoided, and pertinent overhaul and maintenance can be carried out.

For example, the hydraulic pressure of the clutch hydraulic system can be detected by the above-mentioned first pressure sensor, that is, the hydraulic pressure value of the hydraulic oil provided by the clutch hydraulic system to the clutch.

In some examples, the control method further includes: detecting the pressure of the liquid output by the plunger pump; and controlling the clutch to disengage if the detected pressure of the liquid output by the plunger pump is higher than a second preset pressure value. Therefore, if the pressure of the liquid output by the liquid output end of the plunger pump is higher than the second preset pressure value, there may be a problem with the clutch. In this case, the fracturing apparatus can control the clutch to disengage, so that the fault can be found and treated in time. It should be noted that the above-mentioned second preset pressure value can be a safe pressure value.

For example, the pressure of the liquid output by the plunger pump can be detected by the second pressure sensor described above.

In some examples, the control method further includes: detecting the temperature of the clutch; and controlling the clutch to disengage if the detected temperature of the clutch is higher than a first preset temperature value. Therefore, upon the temperature of the clutch being higher than the preset temperature value, the clutch can be controlled to disengage, so that various faults caused by high clutch temperature can be avoided, further deterioration of faults can be avoided, and pertinent overhaul and maintenance can be carried out.

For example, the temperature of the clutch can be detected by the first temperature sensor.

In some examples, the control method further includes: detecting the temperature of hydraulic oil in the clutch hydraulic system; and controlling the clutch to disengage if the detected temperature of the hydraulic oil in the clutch hydraulic system is higher than a second preset temperature value. Therefore, upon the temperature of hydraulic oil in the clutch hydraulic system being higher than the second preset temperature value, the clutch can be controlled to disengage, so that various faults caused by higher clutch temperature can be avoided, further deterioration of faults can be avoided, and pertinent overhaul and maintenance can be carried out.

For example, the temperature of the hydraulic oil in the clutch hydraulic system can be detected by the second temperature sensor.

In some examples, the control method further includes: detecting the vibration of the plunger pump; and controlling the clutch to disengage if the detected vibration of the plunger pump is higher than a first preset vibration value. During the operation process of fracturing apparatus, upon the clutch failing, the transmission between the clutch and the plunger pump will be abnormal, resulting in high vibration value of the plunger pump. Upon the vibration of the plunger pump being greater than the first preset vibration value, the control method can control the clutch to disengage and completely cut off the input power of the plunger pump, thus avoiding the further deterioration of the fault and carrying out pertinent overhaul and maintenance.

For example, the vibration of the plunger pump can be detected by the first vibration sensor described above.

In some examples, the control method further includes: detecting vibration of the prime mover; and controlling the clutch to disengage if the detected vibration of the prime mover is higher than a second preset vibration value. Upon the clutch failing, the transmission between the clutch and the prime mover will be abnormal, resulting in high vibration value of the prime mover. Upon the vibration of the prime mover being greater than the second preset vibration value, the control method can control the clutch to disengage, thus avoiding the further deterioration of the fault, and carrying out pertinent overhaul and maintenance.

In some examples, the control method further includes: detecting a first actual rotation speed of the power input shaft of the plunger pump; detecting a second actual rotation speed of the power output shaft of the prime mover; calculating a ratio of the first actual speed and the second actual speed, and controlling the clutch to disengage if the ratio is smaller than a first preset ratio or greater than a second preset ratio. Therefore, upon the ratio of the first actual speed of the power input shaft of the plunger pump to the second actual speed of the power output shaft of the prime mover being smaller than the first preset ratio or greater than the second preset ratio (i.e., there is no match), it can be judged that the clutch is abnormal. In this case, the control method can control the clutch to disengage, so as to avoid the further deterioration of the fault, and can carry out pertinent overhaul and maintenance.

The following statements need to be explained:

(1) In the drawings of the embodiments of the present disclosure, only the structures related to the embodiments of the present disclosure are involved, and other structures may refer to the common design(s);

(2) In case of no conflict, features in one embodiment or in different embodiments of the present disclosure can be combined.

The above are merely particular embodiments of the present disclosure but are not limitative to the scope of the present disclosure; any of those skilled familiar with the related arts can easily conceive variations and substitutions in the technical scopes disclosed in the present disclosure, which should be encompassed in protection scopes of the present disclosure. Therefore, the scopes of the present disclosure should be defined in the appended claims.

The invention claimed is:

1. A fracturing apparatus, comprising:

a plunger pump, comprising a power end and a hydraulic end;

a prime mover, comprising a power output shaft;

a clutch, comprising a first connection portion, a second connection portion and a clutch portion between the first connection portion and the second connection portion; and a clutch hydraulic system, configured to provide hydraulic oil to the clutch, wherein the power end of the plunger pump comprises a power input shaft, the first connection portion is connected with the power input shaft, the second connection portion is connected with the power output shaft of the prime mover, the fracturing apparatus further comprises a first pressure sensor configured to detect a hydraulic pressure of the clutch hydraulic system, wherein when the hydraulic pressure of the clutch hydraulic system is lower than a first pressure threshold, the clutch is configured to disengage, and wherein the clutch is configured to disengage if a ratio of a rotation speed of the power input shaft to a rotation speed of the power output shaft is smaller than a first preset ratio or greater than a second preset ratio.

2. The fracturing apparatus according to claim 1, further comprising:

a second pressure sensor, wherein the hydraulic end of the plunger pump comprises a liquid output end, and the second pressure sensor is configured to detect a pressure of liquid output by the liquid output end, wherein when the pressure of the liquid output by the liquid output end is greater than a second pressure threshold, the clutch is configured to disengage.

3. The fracturing apparatus according to claim 2, further comprising:

a discharge manifold, connected with the liquid output end, wherein the second pressure sensor is arranged on the liquid output end or the discharge manifold.

4. The fracturing apparatus according to claim 1, wherein the plunger pump is a first plunger pump, the clutch is a first clutch, and the clutch hydraulic system is a first clutch hydraulic system, and the fracturing apparatus further comprises a second plunger pump, a second clutch, a second clutch hydraulic system, and a second pressure sensor, wherein the second clutch hydraulic system is coupled to the second clutch, and the second clutch is disposed between the second plunger pump and the prime mover, and wherein the second pressure sensor is configured to detect a hydraulic pressure of the second clutch hydraulic system.

5. The fracturing apparatus according to claim 1, further comprising:

a first temperature sensor, configured to detect a temperature of the clutch, wherein when the temperature of the clutch is greater than a first temperature threshold, the clutch is configured to disengage.

6. The fracturing apparatus according to claim 5, further comprising:

a second temperature sensor, configured to detect a temperature of hydraulic oil in the clutch hydraulic system, wherein when the temperature of the hydraulic oil in the clutch hydraulic system is greater than a second temperature threshold, the clutch is configured to disengage.

7. The fracturing apparatus according to claim 1, further comprising:

a first vibration sensor, configured to detect vibration of the plunger pump, and a plunger pump base, wherein the plunger pump is arranged on the plunger pump base, and the first vibration sensor is arranged on the plunger pump or the plunger pump base, wherein when the vibration of the plunger pump is greater than a first vibration threshold, the clutch is configured to disengage.

8. The fracturing apparatus according to claim 1, further comprising:

a second vibration sensor, configured to detect vibration of the prime mover, and a prime mover base, wherein the prime mover is arranged on the prime mover base, and the second vibration sensor is arranged on the prime mover or the prime mover base, wherein when the vibration of the prime mover is greater than a second vibration threshold, the clutch is configured to disengage.

9. The fracturing apparatus according to claim 1, further comprising:

a first rotation speed sensor, configured to detect the rotation speed of the power input shaft of the plunger pump; and a second rotation speed sensor, configured to detect the rotation speed of the power output shaft of the prime mover, wherein when the rotation speed of the power input shaft of the plunger pump and the rotation speed of the power output shaft of the prime mover do not conform to a transmission ratio, the clutch is configured to disengage.

10. The fracturing apparatus according to claim 1, further comprising:

a planetary gear box, comprising an input gear shaft, wherein the first connection portion of the clutch is directly connected with the input gear shaft, and the power input shaft is directly connected with the planetary gear box.

11. The fracturing apparatus according to claim 1, wherein the prime mover comprises one of a diesel engine, an electric motor, or a turbine engine.

12. A fracturing system, comprising:

the fracturing apparatus according to claim 1;

a control system configured to control the clutch in the fracturing apparatus; and a remote control unit communicated with the control system.

13. A control method for controlling a fracturing apparatus, the fracturing apparatus comprising:

a plunger pump comprising a power end and a hydraulic end;

a prime mover comprising a power output shaft;

a clutch comprising a first connection portion, a second connection portion, and a clutch portion between the first connection portion and the second connection portion;

a clutch hydraulic system configured to provide hydraulic oil to the clutch, wherein the power end of the plunger pump comprises a power input shaft, the first connection portion is connected with the power input shaft, and the second connection portion is connected with the power output shaft of the prime mover; and a first pressure sensor, the control method comprising:

detecting, by the first pressure sensor, a hydraulic pressure of the clutch hydraulic system;

controlling the clutch to disengage if the hydraulic pressure of the clutch hydraulic system is lower than a first pressure threshold;

detecting a first rotation speed of the power input shaft of the plunger pump;

detecting a second rotation speed of the power output shaft of the prime mover; and calculating a ratio of the first rotation speed and the second rotation speed, and controlling the clutch to disengage if the ratio is smaller than a first preset ratio or greater than a second preset ratio.

14. The control method according to claim 13, further comprising:

detecting, by a second pressure sensor, a pressure of liquid output by the plunger pump; and controlling the clutch to disengage if the pressure of the liquid output by the plunger pump is greater than a second pressure threshold.

15. The control method according to claim 13, further comprising:

detecting a temperature of the clutch; and controlling the clutch to disengage if the temperature of the clutch as detected is higher than a first temperature threshold.

16. The control method according to claim 15, further comprising:

detecting a temperature of hydraulic oil in the clutch hydraulic system; and controlling the clutch to disengage if the temperature of the hydraulic oil in the clutch hydraulic system as detected is higher than a second temperature threshold.

17. The control method according to claim 13, further comprising:

detecting a vibration of the plunger pump; and controlling the clutch to disengage if the vibration of the plunger pump as detected is higher than a first vibration threshold.

18. The control method according to claim 17, further comprising:

detecting a vibration of the prime mover; and controlling the clutch to disengage if the vibration of the prime mover as detected is higher than a second vibration threshold.

* * * * *